US007575339B2

(12) United States Patent
Hung

(10) Patent No.: US 7,575,339 B2
(45) Date of Patent: Aug. 18, 2009

(54) LED LAMP

(75) Inventor: Tang-Yueh Hung, Taichung Hsien (TW)

(73) Assignee: Zing Ear Enterprise Co., Ltd., Taichung Hsien (TW)

( * ) Notice: Subject to any disclaimer, the term of this patent is extended or adjusted under 35 U.S.C. 154(b) by 227 days.

(21) Appl. No.: 11/829,991

(22) Filed: Jul. 30, 2007

(65) Prior Publication Data

US 2009/0034266 A1 Feb. 5, 2009

(51) Int. Cl.
*F21V 21/00* (2006.01)

(52) U.S. Cl. ..... 362/230; 362/545; 362/249.02; 362/362; 362/800

(58) Field of Classification Search ..... 362/230, 362/231, 545, 227, 234, 235, 240, 249.02, 362/249.13, 294, 362, 612, 555, 800
See application file for complete search history.

(56) References Cited

U.S. PATENT DOCUMENTS 6,161,910 A * 12/2000 Reisenauer et al. ..... 315/309
6,626,557 B1 * 9/2003 Taylor ..... 362/235
6,799,864 B2 * 10/2004 Bohler et al. ..... 362/236
6,948,829 B2 * 9/2005 Verdes et al. ..... 362/227
2006/0146553 A1 * 7/2006 Zeng et al. ..... 362/488

OTHER PUBLICATIONS

U.S. Appl. No. 11/830,017, filed Jul. 30, 2007, Tang-Yueh Hung.
U.S. Appl. No. 11/830,033, filed Jul. 30, 2007, Tang-Yueh Hung.

* cited by examiner

*Primary Examiner*—Bao Q Truong
(74) *Attorney, Agent, or Firm*—Ming Chow Sinorica, LLC

(57) ABSTRACT

An LED lamp includes a housing, at least one circuit board, several LED and two electric wires. The LED are mounted on a bottom face of the circuit board. The circuit board and the LED are all installed in the housing with the LED located at a bottom end of the housing. Two through holes are formed on a top end of the housing. The electric wires respectively passed through the through holes of the housing to electrically connect with the circuit board. The LED lamp is inbuilt with LED so that it is unnecessary to further install any LED bulb. The electric wires can be serially connected so that multiple LED lamps can be easily connected.

9 Claims, 4 Drawing Sheets

LED LAMP

BACKGROUND OF THE INVENTION

The present invention is related to a lamp, and more particularly to an LED lamp.

It is known that LED can emit light at low power consumption. Therefore, it is a trend to replace the traditional lamp with LED. In general, LED is manufactured to have a form of bulb. Under such circumstance, in use, LED must be seated in a bulb socket. This is inconvenient.

Furthermore, the conventional LED lamp can not be serially connected or parallelly connected. Therefore, the brightness of the LED lamp is fixed and unadjustable. In the case that higher brightness is needed, the illumination provided by the conventional LED equipment will be insufficient.

SUMMARY OF THE INVENTION

It is therefore a primary object of the present invention to provide a lamp which is directly inbuilt with LED.

It is a further object of the present invention to provide the above LED lamps which can be connected with each other to increase the brightness.

The present invention can be best understood through the following description and accompanying drawings wherein:

DETAILED DESCRIPTION OF THE PREFERRED EMBODIMENTS

Figure 1:
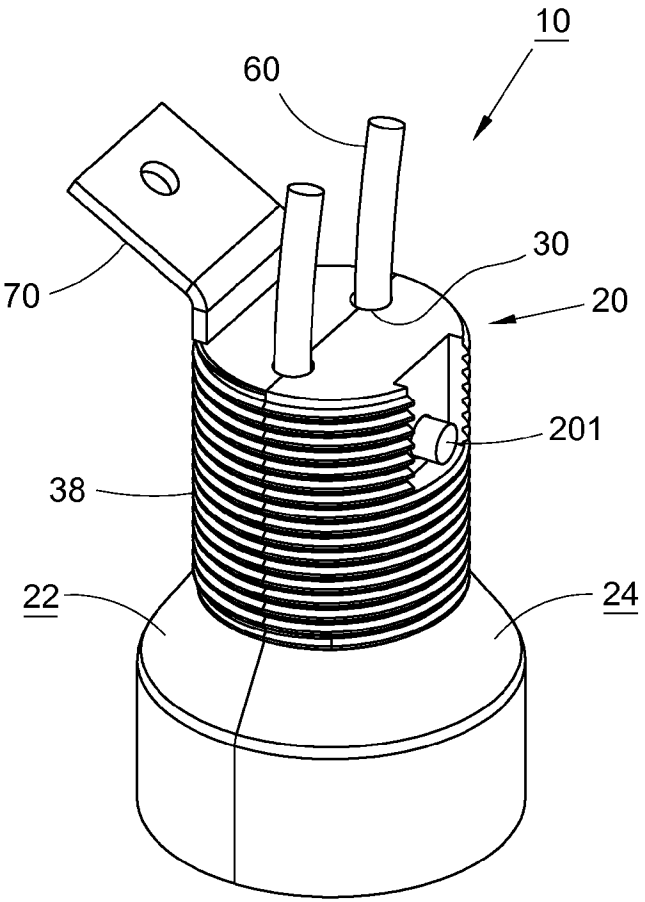
FIG. 1 is a perspective assembled view of the LED lamp of the present invention.
Figure 2:
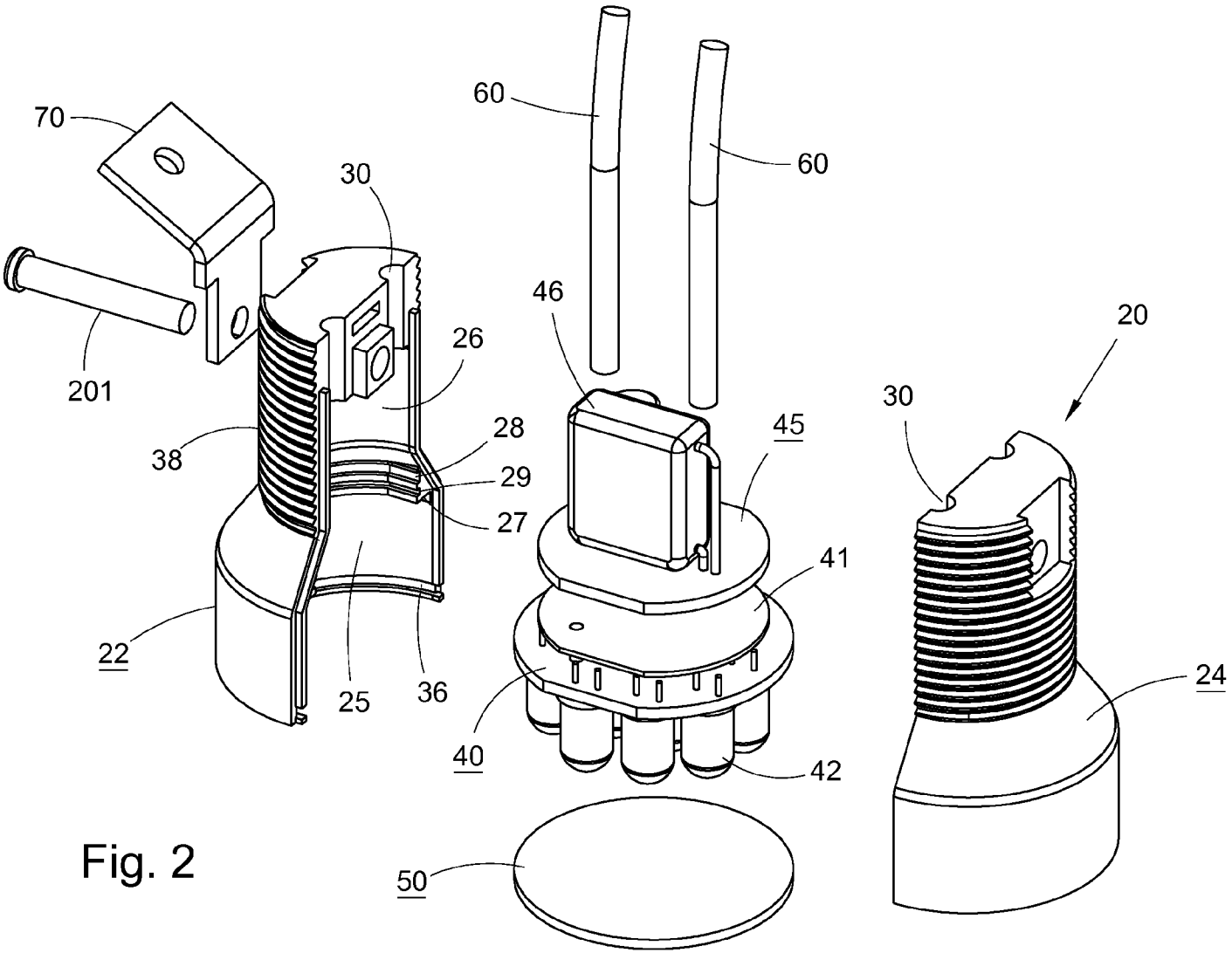
FIG. 2 is a perspective exploded view of the LED lamp of the present invention according to FIG. 1.

Please refer to FIGS. 1 and 2. According to a preferred embodiment of the present invention, the LED lamp 10 includes a housing 20 and LED as well as circuit boards installed in the housing 20.

The housing 20 is composed of two symmetric halves 22, 24 mated with each other. The two halves 22, 24 are locked with each other by means of a screw member or a rivet 201. The housing 20 is hollow, having a lower chamber 25, an upper chamber 26 and two locating sections 27, 28 located between the two chambers. A bottom end of the housing 20 is an open end. The lower chamber 25 is located at the bottom end of the housing, while the upper chamber 26 is closer to a top end of the housing to communicate with the lower chamber 25. The two locating sections are grooved structures formed on inner wall face of the housing. The lower locating section 27 is near the lower chamber 25, while the upper locating section 28 is near the upper chamber 26. Two through holes 30 are formed on a top end of the housing 20. Bottom ends of the through holes 30 communicate with the upper chamber 26.

In practice, each of the chambers, the locating sections and the through holes is divided into two halves respectively formed in the two halves of the housing.

Figure 3:
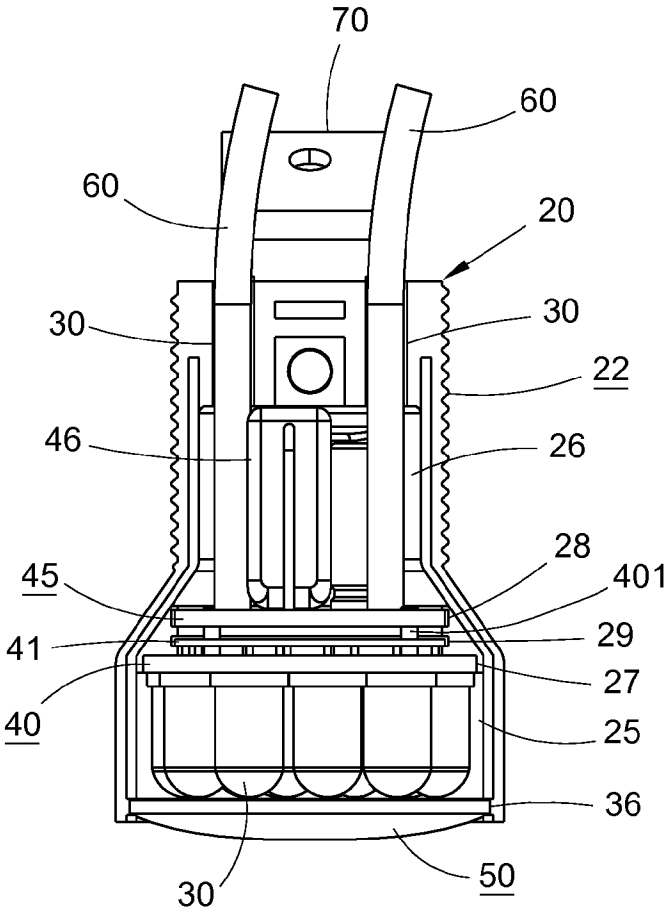
FIG. 3 is a side view of the LED lamp of the present invention, in which a half of the housing is removed.

Two circuit boards 40, 45 are horizontally parallelly arranged and electrically connected with each other via connecting wires 401 as shown in FIG. 3. The two circuit boards are separated from each other by an insulating board 41. The two circuit boards are printed with circuits. Several LED 42 are soldered on a bottom face of the lower circuit board 40. Several electronic elements 46 are soldered on a top face of the upper circuit board 45. The circuit boards 40, 45 together with the LED 42 and the electronic elements 46 are installed in the housing 20. The lower circuit board 40 is positioned in the lower locating section 27 as shown in FIG. 3, while the upper circuit board 45 is positioned in the upper locating section 28. The insulating board 41 is positioned in a third locating section 29 between the locating sections 27, 28. The LED 42 are located in the lower chamber 25, while the electronic elements 46 are located in the upper chamber 26.

A lens 50 is inlaid in an annular groove 36 of the housing 20 to block the open bottom end of the housing 20. The light emitted from the LED can pass through the lens 35.

Two electric wires 60 are respectively passed through the through holes 30 of the housing 20. Inner ends of the electric wires 60 extend into the upper chamber 26 to be soldered on the upper circuit board 45. Outer ends of the electric wires 60 extend out of the housing 20.

The above components are assembled to form a lamp with LED. The two electric wires 60 can be connected to a power source to light up the LED 42. An outer circumference of the housing 20 is formed with a thread 38. Accordingly, the LED lamp can be screwed and fixed in a certain position. Alternatively, a connecting member 70 such as an iron plate can be fixed on the outer circumference of the housing. By means of the connecting member 70, the LED lamp can be fixed in a certain position.

The LED lamp 10 can be solely used. When it is necessary to increase the brightness and the illumination, the electric wires 60 with multiple LED lamps can be parallelly connected or serially connected. Accordingly, the LED lamps can be easily serially or parallelly connected and the number of the connected LED lamps is not limited.

It should be noted that in practice, the two circuit boards can be integrated into one piece and the LED and the electronic elements are respectively soldered on a bottom face and a top face of the circuit board.

According to the above arrangement, the LED lamp is directly inbuilt with LED and can be directly used. Therefore, it is unnecessary to further install any LED bulb. The power consumption of such LED lamp is much lower than that of the traditional lamp employing conventional bulb.

The LED lamp of the present invention can be solely used. Alternatively, multiple LED lamps can be connected by means of connecting the electric wires to increase the brightness and the illumination.

Figure 4:
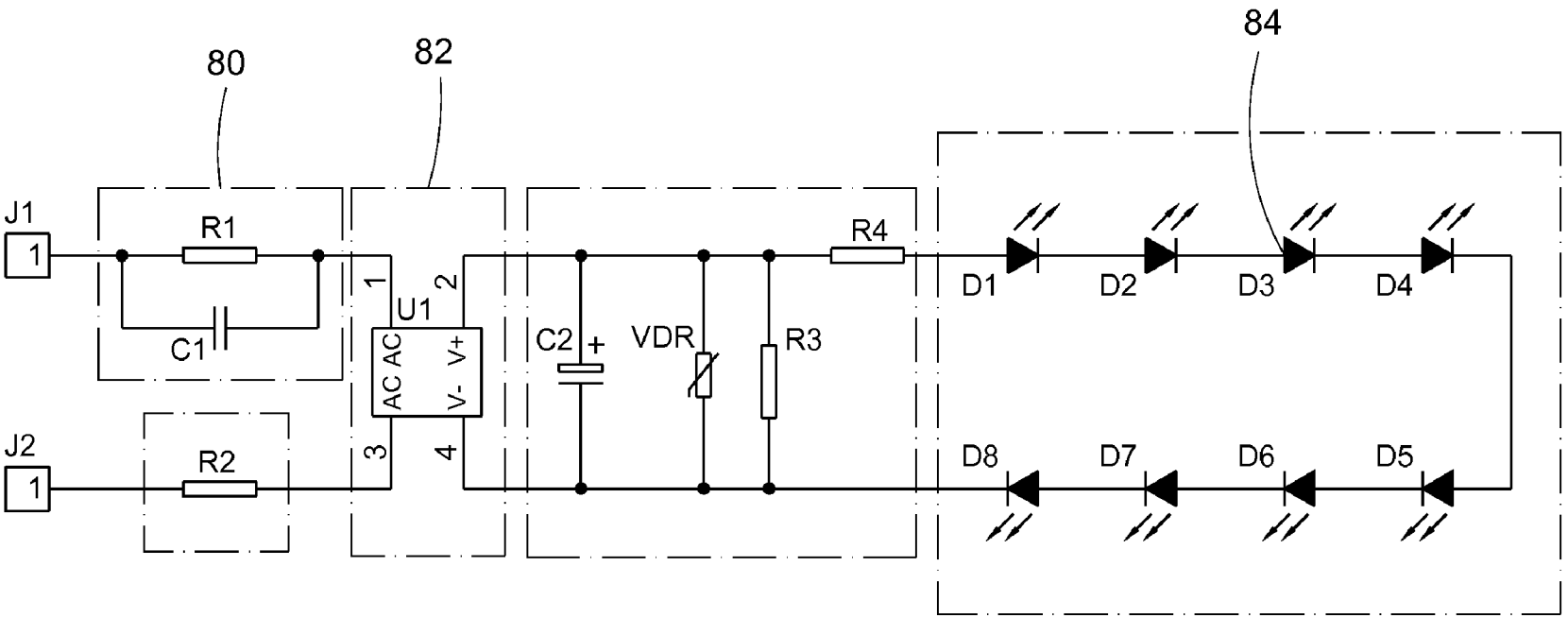
FIG. 4 shows a circuit diagram used in the invention.

FIG. 4 shows a circuit device used in the present invention, which includes a pull-down circuit 80, a rectifier circuit 82 and several series-connected LED 84.

J1 and J2 are contacts. The pull-down circuit 80 comprises a resistor R1 and a capacitor C1. A resistor R2 offers a current-limiting effect and protects the circuit device from short circuit just like a fuse. The U1 of the rectifier circuit 82 is a bridge rectifier (rectifying diode). A capacitor C2 provides a filtering effect. A surge absorber VDR protects the LED 84 from impulse voltage.

Figure 5:
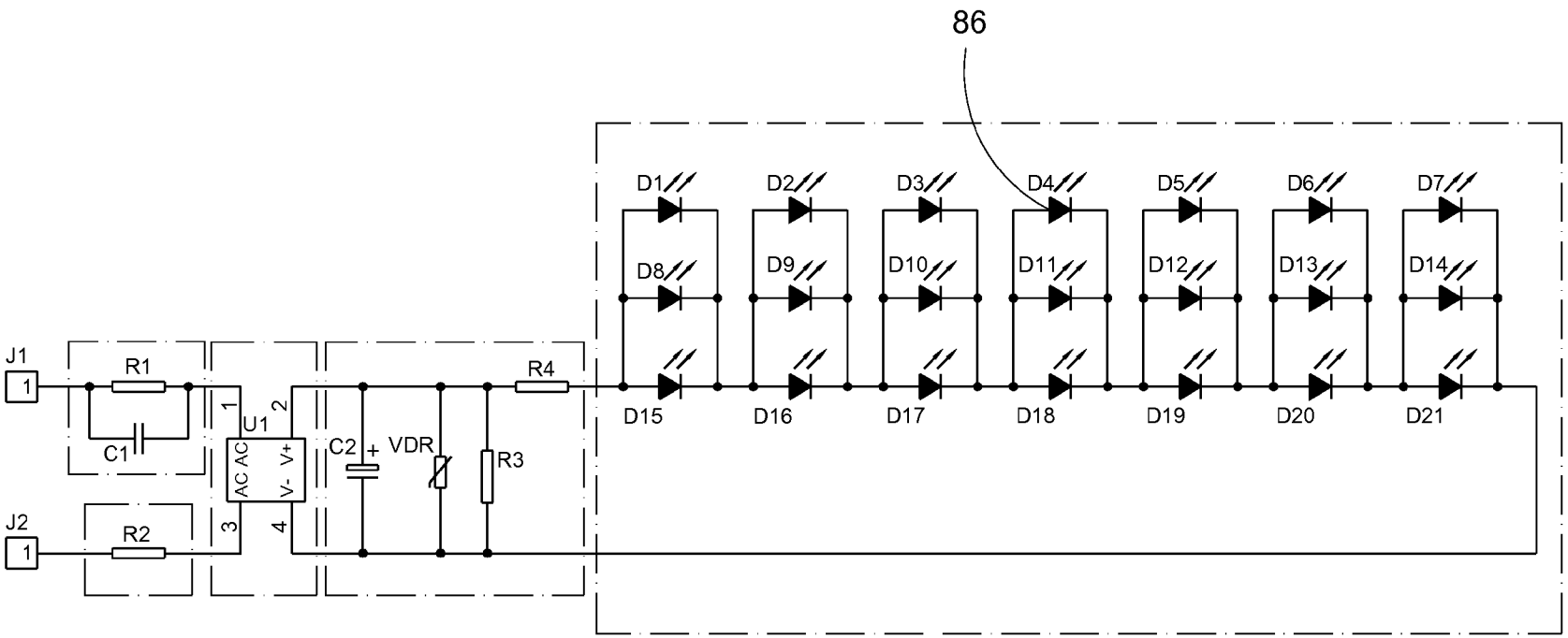
FIG. 5 shows another circuit diagram used in the invention.

FIG. 5 shows another circuit device used in the present invention in which the LED 86 are series-parallel connected.

The above embodiments are only used to illustrate the present invention, not intended to limit the scope thereof. Many modifications of the above embodiments can be made without departing from the spirit of the present invention.

What is claimed is:

1. An LED lamp comprising:

a housing having a bottom end which is an open end, the housing being hollow, having a lower chamber and an upper chamber communicating with each other, the lower chamber being located at the bottom end of the housing, while the upper chamber being closer to a top end of the housing; at least one locating section being formed on inner wall face of the housing between the lower chamber and the upper chamber; two through holes being formed on a top end of the housing, inner ends of the through holes respectively communicating with the upper chamber;

at least one circuit board;

several LEDs mounted on a bottom face of the circuit board and several electronic elements electrically connected with the circuit of the circuit board; the circuit board together with the LEDs and the electronic elements being installed in the housing, the circuit board being positioned in the locating section, the LEDs being located in the lower chamber, while the electronic elements being located in the upper chamber; and two electric wires respectively passed through the through holes of the housing, inner ends of the electric wires extending into the upper chamber to connect with the circuit board, outer ends of the electric wires extending out of the housing.

2. The LED lamp as claimed in claim 1, wherein an upper locating section and a lower locating section are formed on inner wall face of the housing; a lower circuit board and an upper circuit board being horizontally parallelly arranged and electrically connected with each other, the lower circuit board being positioned in the lower locating section near the lower chamber, while the upper circuit board being located in the upper locating section near the upper chamber; the LEDs being mounted on a bottom face of the lower circuit board, while the electronic elements being mounted on a top face of the upper circuit board.

3. The LED lamp as claimed in claim 2, wherein the inner ends of the electric wires are connected to the upper circuit board.

4. The LED lamp as claimed in claim 2, wherein the two circuit boards are separated from each other by an insulating board.

5. The LED lamp as claimed in claim 4, wherein a third locating section is formed on the inner wall face of the housing between the two locating sections; the insulating board is positioned in the third locating section.

6. The LED lamp as claimed in claim 1, further comprising a lens mounted at a bottom end of the housing.

7. The LED lamp as claimed in claim 2, further comprising a lens mounted at a bottom end of the housing.

8. The LED lamp as claimed in claim 1, wherein an outer circumference of the housing is formed with a thread.

9. The LED lamp as claimed in claim 1, further comprising a connecting member mounted on an outer circumference of the housing.

* * * * *